United States Patent [19]

Gerson et al.

[11] 3,964,162

[45] June 22, 1976

[54] BLADE SCRAPER

[75] Inventors: Ronald L. Gerson, Newton; Lawrence A. Caprio, Whitman, both of Mass.

[73] Assignee: Louis M. Gerson Co., Inc., Middleboro, Mass.

[22] Filed: June 25, 1975

[21] Appl. No.: 590,278

[52] U.S. Cl. ..... 30/162; 30/125

[51] Int. Cl.[2] ..... B26B 1/08

[58] Field of Search ..... 30/162, 169, 125, 335

[56] References Cited

UNITED STATES PATENTS

| | | | |
|---|---|---|---|
| 3,845,554 | 11/1974 | Joanis | 30/125 |
| 3,855,700 | 12/1974 | Gerson | 30/162 |
| 3,872,591 | 3/1975 | Quenot | 30/162 |

*Primary Examiner*—Al Lawrence Smith
*Assistant Examiner*—J. C. Peters
*Attorney, Agent, or Firm*—Wolf, Greenfield & Sacks

[57] ABSTRACT

A blade scraper has a hand grip casing with a blade storage compartment and a slide mounted in a chamber of the casing for holding a razor blade and permitting retraction of the razor blade into an inoperative position and sliding movement to an operative position with the blade in a scraping position exposed outside of the chamber. A pressure sensitive locking button acts to lock the blade in the inoperative position or the exposed position. A safety button is interconnected with the slide so that pressure must be applied to two actuating buttons in order to expose the blade thus making it difficult for small children to accidentally place the scraper in a mode of operation dangerous for handling. The slide carries a safety dowel for locking the blade compartment when the blade is locked in its inoperative position.

7 Claims, 7 Drawing Figures

FIG. 1
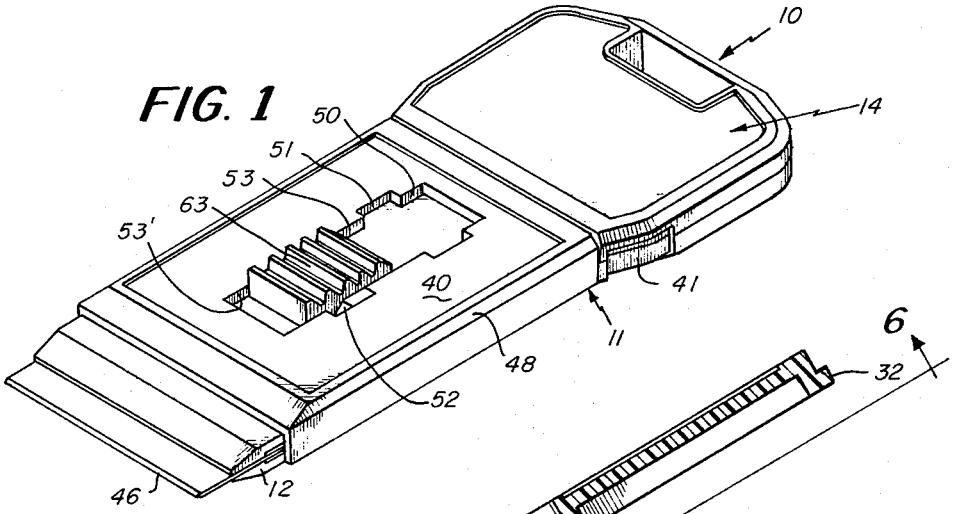
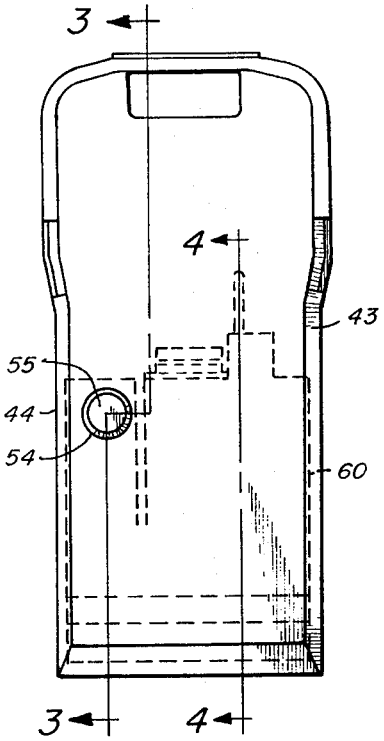
FIG. 2
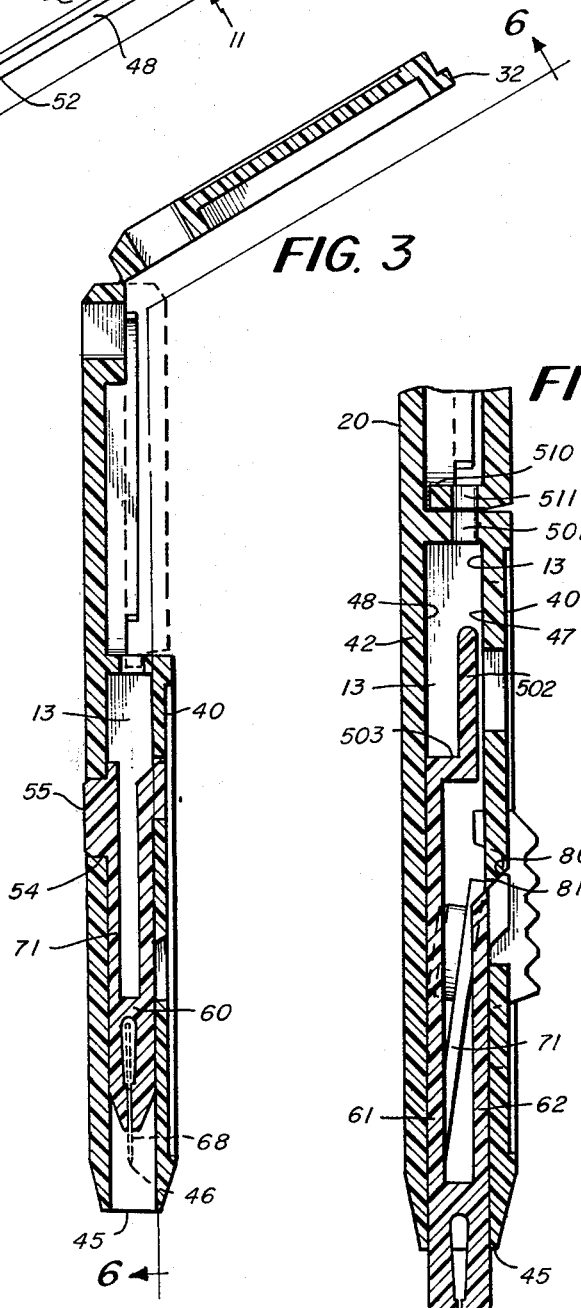
FIG. 3
FIG. 4
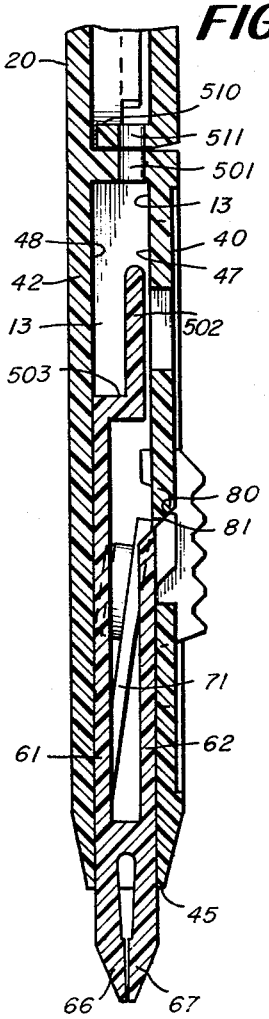

BLADE SCRAPER

BACKGROUND OF THE INVENTION

Razor blade holding scrapers have been known for many, many years. More recently, plastic body scrapers have come into use because of ease of manufacture and reduction in cost over well-known metallic handled scrapers. Such scrapers are commonly used for scraping paint and other unwanted materials from surfaces such as glass surfaces and the like.

Particularly with plastic bodied scrapers having a plastic slide holding a razor blade for movement to encased or to operative positions, locking means for holding the blade in position against the scraping forces encountered are sometimes a problem to properly design. Because of the softer nature of plastic as opposed to metal, high scraping forces sometimes causes dislodgement of the locking means and blade.

Razor blade scrapers in common usage can be inherently dangerous devices when in the hands of young children. Once the razor blade is exposed, the sharp cutting edge presents a serious hazard to unwary handlers of the device. In most known blade scrapers, it is extremely simple to move the blade from an inoperative enclosed position to its operative position as by the use of a single button or slide easily operable by young children.

Many of the above problems have been overcome by our invention described in U.S. Pat. No. 3,855,700 issued Dec. 24, 1974. However, that patent still leaves unsolved a safety feature for the blade storage compartment commonly associated with plastic blade scraper holders. This invention is an improvement over our prior U.S. Pat. No. 3,855,700.

SUMMARY OF THE INVENTION

It is an object of this invention to provide a novel and efficient cutting device having a slide carrying a razor blade for movement between an operative and an inoperative position and also having a razor blade storage compartment with safety means for locking the razor blade storage compartment in the inoperative position of the slide.

Still another object of this invention is to provide a novel and efficient cutting device in accordance with the preceding object wherein the safety means for locking the blade storage compartment is interrelated with the slide which also carries a safety means and actuating button so that actuation of at least two different means are necessary to expose the blade for use and/or to disengage a safety lock from the blade storage compartment.

Still another object of this invention is to provide a cutting device in accordance with the preceding objects which can be efficiently manufactured from plastic materials and has desirable strength and rigidity for a wide variety of scraping applications while allowing safe handling of the device when in the inoperative position.

According to the invention, a razor blade cutting device has a hand gripping casing with an enclosed blade storage compartment. The compartment has a hinged cover. A slide with means for mounting and carrying the cutting blade is positioned within a portion of the casing and the slide moves in a chamber which in turn defines an opening preferably at an end of the casing. A pressure activated locking means is provided for locking the slide and blade in a first retracted position with the blade wholly within and encased by the chamber and in a second position with the blade moved through the opening and exposed out of the chamber in an operative cutting position. A pressure actuated safety means provides a safety lock to hold the slide and blade in the first position while permitting release of the slide upon pressure actuation so that pressure must be applied both to the safety means and locking means simultaneously to expose the blade. A second safety means comprises a stop means for preventing opening of the cover unless the locking means and safety means are actuated to move the slide from the first position.

Preferably the second safety means is in the form of a dowel interengaging a corresponding hole provided in the cover to lock the cover in place. The dowel is preferably mounted directly on the slide so that actuation of the locking means and safety button to move the slide, automatically moves the dowel from the hole in the cover freeing the cover and enabling it to be opened.

It is a feature of this invention that when the blade is in the inoperative position in the casing, a small child cannot easily release the blade and cannot open the blade storage compartment. Thus, two manipulations must be carried out by the user simultaneously in order to expose the blade for cutting and scraping and enable opening of the blade storage compartment.

It is still another feature of the invention that the cutting device can be molded of plastic materials rapidly and inexpensively with the two safety features not adding substantially to the cost of molding or assembly.

BRIEF DESCRIPTION OF THE DRAWINGS

The above and other objects, features and advantages of the present invention will be better understood from a reading of the following specification in conjunction with the accompanying drawings in which:

FIG. 1 is a top perspective view of a preferred embodiment of this invention;

FIG. 2 is a rear view thereof;

FIG. 3 is a cross sectional view taken through line 3—3 of FIG. 2 with the slide in a first encased or inoperative position;

FIG. 4 is a fragmentary side cross sectional view taken through line 4—4 of FIG. 2 with the slide in its operative scraping position;

DESCRIPTION OF PREFERRED EMBODIMENTS

Figure 5:
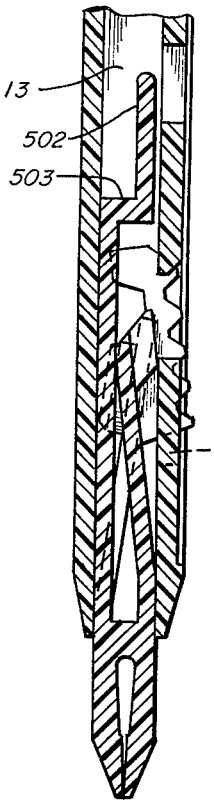
FIG. 5 is a fragmentary side cross sectional view taken through line 4—4 of FIG. 2 with the slide in a third outermost position enabling mounting and dismounting of a razor blade.

With reference now to the drawings, a preferred embodiment of a blade scraper is shown generally at 10 in FIG. 1 and has a hand grirpping casing 11 carrying a razor blade holding slide portion 12 in a chamber 13 at a forward section with a rear section defining a razor blade storage compartment 14.

The hand gripping casing 10 is designed to be comfortably held in the hand of the user to allow scraping with the device held at an angle to a surface such as a window to be scraped of paint. The rear storage compartment 14 is formed by a bottom wall 20 with upstanding walls 21, 22, 23 and 24 with wall 24 having a cutout 25 therein. Walls 21 and 23 have upstanding ribs 26 and 27 which mate with walls 28 and 29 when the upper lid 30 is closed. Lid 30 is integrally hinged at 31 to rear wall 22 and provided with cutout recess 32 aligned with a recess 39 to enable hanging of the device by a hook or other means. A resilient locking tab 33 extends outwardly from a wall 34 of the lid and is designed to pass within the recess 25 and be snapped against a front wall 40 of the blade holding section of the scraper. A finger cutout portion 41 is formed on the outside of side walls 21 and 23 so that the fingers can pass beneath the lid and pull the lid up from its locked position. The lid snaps into its closed position as shown in FIG. 1 upon applying finger pressure to the lid. The compartment 14 is designed to have sufficient size to store conventional single edge scraping razor blades.

Cover or lid 30 carries a tab 510 with a hole 511 therethrough. Hole 511 is axially aligned with a hole 501 of wall 24 to receive a dowel or safety pin 502 as will be described.

The forward section of the hand gripping casing has a front wall 40 and a rear wall 42 which is effectively an extension of wall 20. Side walls 43 and 44 define with the front and rear walls, the slide chamber 13 which has an opening 45 through which the slide passes to expose the razor blade knife edge 46 in the operative position of the scraper. Walls 40 and 42 provide surfaces 47 and 48 which are preferably parallel and on which the slide is mounted for reciprocal sliding to the positions shown in FIGS. 3–5. In the preferred embodiment, the top surface of the scraper has an upstanding beveled perimeter indicated at 48 extending therearound.

Top wall 40 has a cutout slot 50 axially aligned along the path of travel of the slide and defining a locking cutout 51 and a second locking cutout 52 with a portion of the slot 53' defining a forward end 53 thereof beyond the locking cutout 52.

Rear wall 42 defines a hole 54 adapted to receive a safety button 55 carried by the slide.

The slide which holds a razor blade therein and moves it from an inoperative encased position to an operative position and beyond for exchanging the razor blade, is denoted generally at 60. Preferably it is formed as an integral piece of a resilient plastic such as polystyrene, Delrin, acetal or the like. The slide has a planar rear leg 61 carrying the safety button 55 and a forward planar leg 62 carrying an actuating and locking button 63. Button 63 has side extensions or nibs 64 on either side thereof adapted to lock the slide in the locking cutouts 51 or 52 as desired. Legs 61 and 62 meet at a forward portion 65 of the slide beyond which are forwardly extending jaws 66 and 67 normally biased toward each other into touching engagement as best shown in FIG. 4. Upon insertion of a standard single edge razor blade such as 68, the jaws 66 and 67 are resiliently spread apart to firmly hold the razor blade in fixed position with respect to the slide with the blade cutting edge 46 adapted for movement along a planar path into and out of the casing as exemplified by FIGS. 3–5.

The legs 61 and 62 are preferably molded to have a dimension such that they are spread apart in their unstressed state to a greater degree than when mounted within the slide chamber 13. Thus when the slide is mounted within the chamber 13 as best shown in FIGS. 3–5, the legs are resiliently urged against the sliding surfaces 47 and 48 with the safety button 55 urged outwardly into the hole 54 and the locking button 63 and its associated side nibs 64 urged outwardly into the cutout 51 in a first encased position of the slide as best shown in FIG. 3.

The slide 60 is in effect a double spring with legs 61 and 62 having a spring action directed outwardly against the surfaces 47 and 48 and the jaws 66 and 67 resiliently urged inwardly to grip and firmly hold a single edge razor blade. The spring action of the safety button is further enhanced by the use of an elongated notch 70 which separates a tab portion of leg 61 enabling it to bend free of the bending action of the remainder of leg portion 61 as best seen in FIG. 4. To further enhance this action, a corner 72 is cut out of leg 62 so that when the safety button is fully depressed the tab portion 71 can extend to the opposite surface 47 without being blocked by the opposing leg 62 as best shown in FIG. 4.

Figure 6:
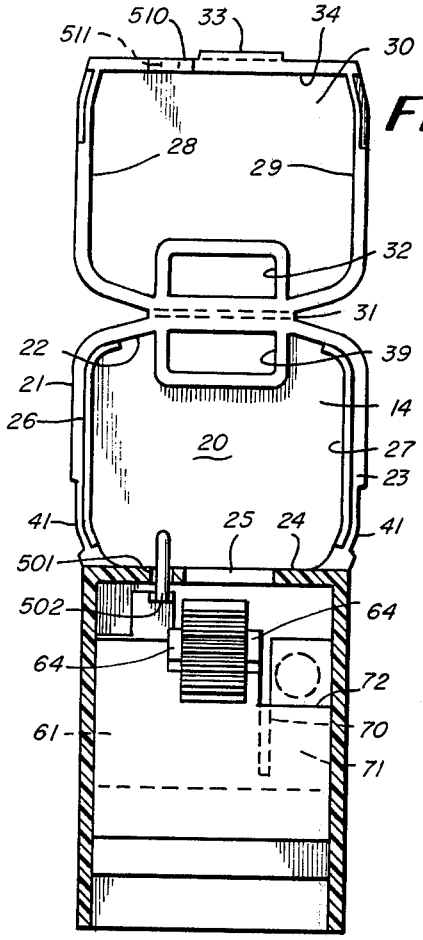
FIG. 6 is a cross sectional view taken through line 6—6 of FIG. 3.
Figure 7:
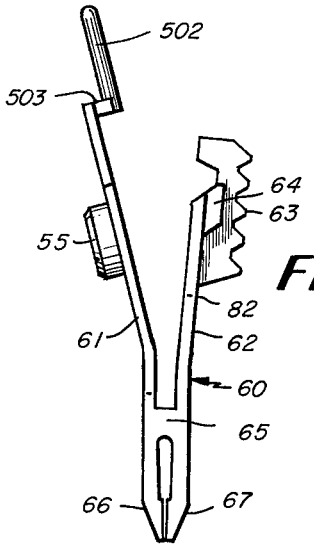
FIG. 7 is a side view of the slide thereof.

The slide 60 carries a dowel extension 502 preferably mounted on a shelf extension 503 and spaced above the plane of the slide portion leg 61. The dowel extension moves along the axial path of movement of the slide preferably perpendicular to the hinged edge 31 and in the withdrawn position of the blade shown in FIG. 6, passes through holes 501 and 511 to lock the cover in place when it is prepositioned in the closed position. In the second position of the slide when it moves from the first position shown in FIG. 6, the length of the dowel is such that it is withdrawn from the holes when the blade is out in the position of FIG. 4 or FIG. 5. Thus the cover is free to be opened to the position shown in FIG. 3 if desired. This feature prevents a child or other user from opening the blade storage device when the slide is in the inoperative position and presumably the device is stored. Thus small children must simultaneously operate the first safety button and the locking button in order to expose the razor blade or have access to razor blades stored in the razor blade storage compartment of the blade scraper.

Turning now to operation of the device, slide 60 has a first position illustrated in FIG. 3 with the locking nibs of the locking button 63 extending through the cutout 51 at which time the safety button 55 passes through the cutout 54 together locking the razor blade 68 in the encased retracted position with the cutting edge 46 shielded by the case. In order to activate sliding, the button 63 is depressed until the nibs 64 pass below the surface 47 and the safety button 55 is depressed sliding the slide to the position shown in FIG. 4 where the nibs are positioned in the cutout 52. in this position the nibs 64 of the locking button alone provide a locking means for locking the blade in its operative position extending through the opening 45 with the blade cutting and scraping edge 46 exposed. As best shown in FIG. 4, sliding surfaces 80 are provided on the edge of cutout 52 and mate with complementary surfaces 81 on each of the nibs on either side of the button 63. These surfaces are angled at an acute angle to the plane of the razor blade travel. Thus when a scraping force is exerted toward the cutting edge 46 along the plane of the blade, the slide 60 moves slightly rearwardly and the nibs provide complementary surfaces which tend to wedge the locking nibs into engagement along surfaces 80 and 81 pulling upwardly on surface 82 of the leg 62 and wedging it into engagement with slide surface 47 causing a wedging action which resists substantial scraping forces without causing the locking nibs to spring out of the locking cutouts. This feature is important in the preferred embodiment since the preferred embodiment is formed of relatively soft polypropylene or other plastic material having walls of approximately 0.08 inch thick. Unless a wedge action is included, large scraping forces could tend to dislodge the blade from its locked position. As described above, the cover 30 can only be raised when the slide is moved from the enclosed or rest position.

In a third position of the slide shown in FIG. 5, the button 62 is again depressed to cause nibs 64 to slide along surface 47 until the button meets the forward edge 53' whereupon the razor blade holding slot between the jaws 66 and 67 are exposed enabling a single edge razor blade to be slid laterally out of the holder and a new blade positioned therein for replacement of worn out blades.

It is a feature of this invention that the safety button provides a double lock which requires pressure actuation at two distinct points in order to unsheath the blade. This feature makes it difficult for young children or others to release and unsheath the blade or open the blade storage compartment by mistake or tampering as opposed to conventional devices which require pressure actuation at a single point.

While a specific embodiment of this invention has been shown and described, many variations thereof are possible. For example, the safety button feature can be incorporated in conventional scrapers and razor blade cutters of various kinds. The specific configuration of parts can vary in many cases. While the generally rectangular outline is preferred with an enlarged case or compartment section for conformity to the hand of the user, other shapes can be used. Similarly, while all parts of the device are preferably formed of molded plastics, other materials can be used for portions or all of the device if desired. The cover can have various shapes and configurations. In all embodiments, it is preferred that the safety means for allowing exposing the blade also act to permit opening of the cover to the blade storage compartment. Polypropylene is a preferred plastic for use for all parts of the scraper although other plastics such as polyethylene, polyvinyl acetate, teflon and the like can also be used.

In the preferred embodiment, the casing has a length from the opening 45 to the rear end of 4 inches with a maximum width of 1¾ inches and a thickness of ⅜ inch. These dimensions can vary greatly as desired.

What is claimed is:

1. A razor blade cutting device comprising, a hand gripping casing having an enclosed blade storage compartment closed by a cover, a slide carrying means for mounting and carrying a cutting blade, said slide being mounted in a chamber defined by said casing with said chamber defining an opening at an end of said casing, pressure activated locking means for locking said slide and blade in a first retracted position with said blade wholly within and encased by said chamber and a second position with said blade moved toward said opening, pressure actuated first safety means providing a safety lock to hold said slide and blade in said first position while permitting release of said slide upon pressure actuation thereof whereby pressure must be applied to said first safety means and said locking means to expose said blade, and second safety means comprising a stop means for preventing opening of said cover unless said locking means and safety means are actuated to move said slide from said first position.

2. A blade cutting device in accordance with claim 1 and further comprising said casing and said slide being formed of a plastic material with said slide mounted for movement along a straight line and mounted for movement only upon simultaneous actuation of said locking means and safety means, said second position having said cutting blade exposed through said opening in an operative cutting position.

3. A blade cutting device in accordance with claim 2 wherein said first safety means and said locking means are positioned on opposite sides of said hand gripping casing.

4. A blade cutting device in accordance with claim 2 wherein said second safety means comprises an elongated hole defined by a portion of said cover and an elongated extension extending from said slide and axially aligned with said hole.

5. A blade cutting device in accordance with claim 4 wherein said cover is hinged along a line perpendicular to a path of movement of said slide from said first to said second position

6. A blade cutting device in accordance with claim 2 wherein said safety means and said locking means are positioned on opposite sides of said hand gripping casing for ease of simultaneous actuation by the fingers of a user and, a wall separates said slide chamber from said blade storage compartment, said wall defining an opening aligned with a hole defined by said cover, said second safety means comprising an extension of said slide adapted to pass through said hole and opening to lock said cover in a closed position.

7. In a blade cutting device comprising, a hand gripping casing having an enclosed blade storage compartment closed by a cover, a slide carrying means for mounting and carrying a cutting blade, said slide being mounted in a chamber defined by said casing with said chamber defining an opening at an end of said casing, pressure activated locking means for locking said slide and blade in a first retracted position with said blade wholly within and encased by said chamber and a second position with said blade moved toward said opening, pressure actuated first safety means providing a safety lock to hold said slide and blade in said first position while permitting release of said slide upon pressure actuation thereof whereby pressure must be applied to said first safety means and said locking means to expose said blade, and second safety means comprising a stop means for preventing opening of said cover unless said locking means and safety means are actuated to move said slide from said first position, the improvement comprising said slide being formed of a resilient material and carrying operative portions of said locking means, first safety means and second safety means.

* * * * *